US007867341B2

(12) United States Patent
Wetzel et al.

(10) Patent No.: US 7,867,341 B2
(45) Date of Patent: Jan. 11, 2011

(54) METHODS AND SYSTEMS FOR PERFORMING AN UPPER RACK WASH IN A DISHWASHER

(75) Inventors: Timothy Martin Wetzel, Louisville, KY (US); Jerrod Aaron Kappler, Louisville, KY (US); Matthew David Mersch, Louisville, KY (US); Joseph Duane Tobbe, Taylorsville, KY (US)

(73) Assignee: General Electric Company, Schenectady, NY (US)

( * ) Notice: Subject to any disclaimer, the term of this patent is extended or adjusted under 35 U.S.C. 154(b) by 1099 days.

(21) Appl. No.: 11/121,649

(22) Filed: May 4, 2005

(65) Prior Publication Data

US 2006/0249181 A1 Nov. 9, 2006

(51) Int. Cl.
*B08B 3/00* (2006.01)

(52) U.S. Cl. ..... 134/56 D; 134/57 D; 134/58 D; 251/65

(58) Field of Classification Search ..... 134/56 R, 134/56 D, 57 R, 57 D, 58 R, 58 D; 251/65
See application file for complete search history.

(56) References Cited

U.S. PATENT DOCUMENTS 4,121,741 A * 10/1978 Adamson ..... 222/181.2
4,741,353 A * 5/1988 Milocco ..... 137/119.03
5,899,433 A * 5/1999 Kim et al. ..... 251/30.01
6,705,330 B1 * 3/2004 Favret ..... 134/56 D
6,752,875 B2 6/2004 Kiesler et al.
2004/0079400 A1 * 4/2004 Young ..... 134/57 D
2004/0255982 A1 * 12/2004 VanderRoest et al. ..... 134/25.2

FOREIGN PATENT DOCUMENTS

DE 42 41 497 * 6/1994

* cited by examiner

*Primary Examiner*—Michael Kornakov
*Assistant Examiner*—Eric Golightly
(74) *Attorney, Agent, or Firm*—George L. Rideout, Esq.; Armstrong Teasdale LLP

(57) ABSTRACT

A dishwasher includes a tub, a fluid circulation assembly, and a water flow blocking mechanism. The assembly includes a pump, which is in flow communication with a lower spray arm via a water passage and at least one other spray arm via a conduit. The water flow blocking mechanism includes a water flow blocking device, a magnet, and a magnet positioning device. The water flow blocking device is normally positioned in a pocket in the conduit. The magnet positioning device is configured to move the magnet from a first position to a second position. When the magnet is in the first position, the water flow blocking device is maintained in the pocket by magnetic forces from the magnet. When the magnet is in the second position, the water flow blocking device is not retained in the pocket by magnetic forces of the magnet.

17 Claims, 9 Drawing Sheets

METHODS AND SYSTEMS FOR PERFORMING AN UPPER RACK WASH IN A DISHWASHER

BACKGROUND OF THE INVENTION

This invention relates generally to dishwashers and, more particularly, to controlling water flow to spray mechanisms in a dishwasher.

Known dishwasher systems include a main pump assembly and a drain pump assembly for circulating and draining wash fluid within a wash chamber located in a cabinet housing. The main pump assembly feeds washing fluid to various spray arm assemblies for generating washing sprays or jets on dishwasher items loaded into one or more dishwasher racks disposed in the wash chamber. Fluid sprayed onto the dishwasher items is collected in a sump located in a lower portion of the wash chamber, and water entering the sump is filtered through one or more coarse filters to remove soil and sediment from the washing fluid.

At least some dishwashers include upper and/or mid level spray arms and lower spray arms. In operation, water is simultaneously supplied to both the upper and/or mid arms and to the lower arm, however, the upper and/or mid arm and lower arm are not operated separate from each other.

Reducing the energy consumption of home appliances, including residential dishwashers, is desirable. Considering that millions of dishwashers currently are employed in residential usage, even small energy savings can amount to a significant overall energy savings. Further, reducing the noise level of dishwashers also is desirable.

BRIEF SUMMARY OF THE INVENTION

In one aspect, a dishwasher having an upper rack wash operation is described. In one example embodiment, the dishwasher comprises a tub, and a fluid circulation assembly for circulating water. The assembly comprises a pump, a lower spray arm, and at least one other spray arm. The at least one other spray arm comprises one of a mid level spray arm and an upper spray arm. The pump is in flow communication with the lower spray arm via a water passage, and the pump is in flow communication with the other spray arm via a conduit/venturi hub that permits water flow around the water passage. The dishwasher further comprises a water flow blocking mechanism comprising a water flow blocking device, a magnet positioned outside the water flow path, and a magnet positioning device coupled to the magnet. The water flow blocking device is normally positioned in a pocket in the pump housing. The magnet positioning device is configured to cause the magnet to move from a first position to a second position. When the magnet is in the first position the water flow blocking device is maintained in the pocket by magnetic forces from the magnet. When the magnet is in the second position the water flow blocking device is not retained in the pocket by magnetic forces of the magnet.

In another aspect, a method for controlling operation of a dishwasher is described. The dishwasher comprises a tub, at least one filter for filtering water in the tub, and a fluid circulation assembly for circulating water. The fluid circulation assembly comprises a pump, a lower spray arm, and one of a mid level spray arm and an upper spray arm. The pump is in flow communication with the lower spray arm via a water passage, and the pump is in flow communication with the other spray arm via a conduit/venture hub that permits water flow around the water passage. A water flow blocking mechanism is provided for blocking water flow to the lower spray arm. The method comprises the steps of operating the water flow blocking mechanism to permit water flow to the lower spray arm, and operating the water flow blocking mechanism to prevent water flow to the lower spray arm.

In a further aspect, a kit is provided including a magnetic water flow blocking device, a magnet configured to magnetically engage the magnetic water flow blocking device, and a magnet positioning device. The magnet positioning device is configured to be coupled to the magnet, and is configured to cause the magnet to move from a first position to a second position. When the magnet is in the first position the water flow blocking device is retained by the magnet and when the magnet is in the second position the water flow blocking device is not retained by the magnet.

DETAILED DESCRIPTION OF THE INVENTION

Figure 1:
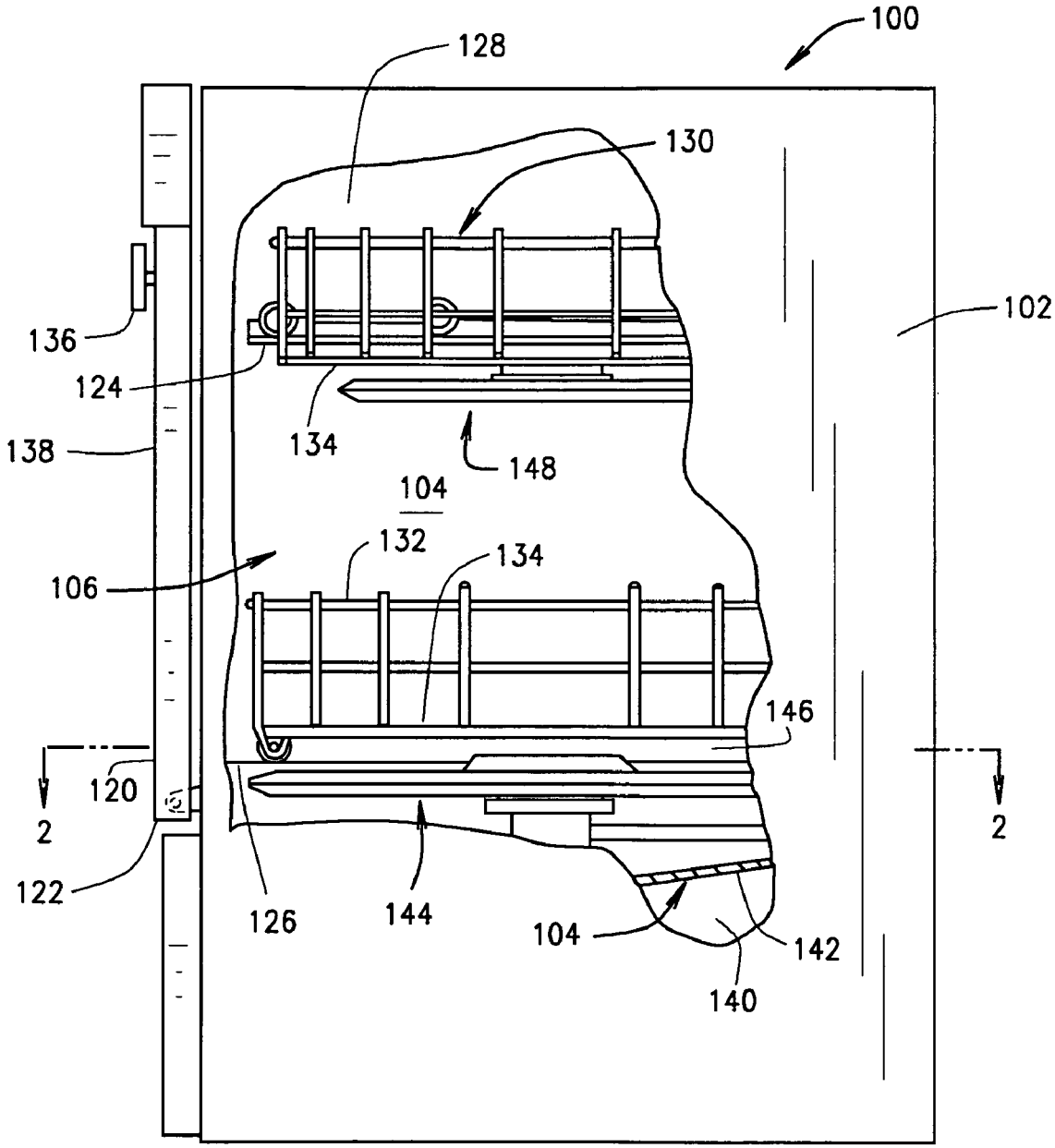
FIG. 1 a side elevation view of an example dishwasher system partially broken away.

FIG. 1 is a side elevation view of an example domestic dishwasher system 100 partially broken away. The flow control mechanism described herein may be practiced in other types of dishwashers and dishwasher systems other than just dishwasher system 100. Accordingly, the following description is for illustrative purposes only, and the flow control is not limited to use in a particular type of dishwasher system, such as dishwasher system 100.

Dishwasher 100 includes a cabinet 102 having a tub 104 therein and forming a wash chamber 106. Tub 104 includes a front opening (not shown in FIG. 1) and a door 120 hinged at its bottom 122 for movement between a normally closed vertical position (shown in FIG. 1) wherein wash chamber is sealed shut for washing operation, and a horizontal open position (not shown) for loading and unloading of dishwasher contents.

Upper and lower guide rails 124, 126 are mounted on tub side walls 128 and accommodate upper and lower roller-equipped racks 130, 132, respectively. Each of upper and lower racks 130, 132 is fabricated from known materials into lattice structures including a plurality of elongate members 134, and each rack 130, 132 is adapted for movement between an extended loading position (not shown) in which at least a portion of the rack is positioned outside wash chamber 106, and a retracted position (shown in FIG. 1) in which the rack is located inside wash chamber 106. Conventionally, a silverware basket (not shown) is removably attached to lower rack 132 for placement of silverware, utensils, and the like that are too small to be accommodated by upper and lower racks 130, 132.

A control input selector 136 is mounted at a convenient location on an outer face 138 of door 120 and is coupled to known control circuitry (not shown) and control mechanisms (not shown) for operating a fluid circulation assembly (not shown in FIG. 1) for circulating water and dishwasher fluid in dishwasher tub 104. In one embodiment, the fluid circulation assembly includes at least one washing water directing device, such as, for example, a spray arm. The fluid circulation assembly is located in a machinery compartment 140 located below a bottom sump portion 142 of tub 104, and its construction and operation is explained in detail below.

A lower spray-arm-assembly 144 is rotatably mounted within a lower region 146 of wash chamber 106 and above tub sump portion 142 so as to rotate in relatively close proximity to lower rack 132. A mid-level spray-arm assembly 148 is located in an upper region of wash chamber 106 in close proximity to upper rack 130 and at a sufficient height above lower rack 132 to accommodate items such as a dish or platter (not shown) that is expected to be placed in lower rack 132. In a further embodiment, an upper spray arm assembly (not shown) is located above upper rack 130 at a sufficient height to accommodate a tallest item expected to be placed in upper rack 130, such as a glass (not shown) of a selected height.

Lower and mid-level spray-arm assemblies 144, 148 and the upper spray arm assembly are fed by the fluid circulation assembly, and each spray-arm assembly includes an arrangement of discharge ports or orifices for directing washing liquid onto dishes located in upper and lower racks 130, 132, respectively. The arrangement of the discharge ports in at least lower spray-arm assembly 144 results in a rotational force as washing fluid flows through the discharge ports. The resultant rotation of lower spray-arm assembly 144 provides coverage of dishes and other dishwasher contents with a washing spray. In various alternative embodiments, mid-level spray arm 148 and/or the upper spray arm are also rotatably mounted and configured to generate a swirling spray pattern above and below upper rack 130 when the fluid circulation assembly is activated.

Figure 2:
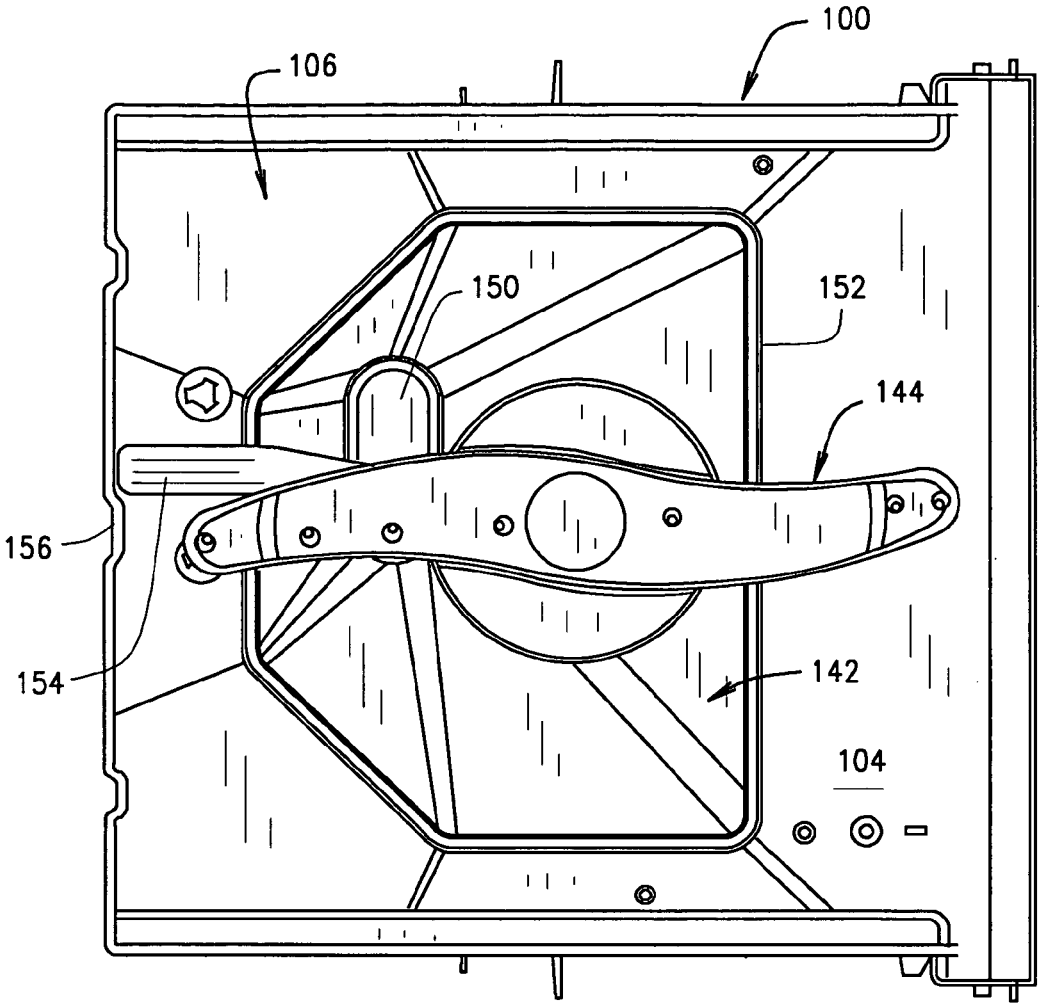
FIG. 2 is a top plan view of a portion of the dishwasher system shown in FIG. 1 along line 2-2.

FIG. 2 is a top plan view of a dishwasher system 100 just above lower spray arm assembly 144. Tub 104 is generally downwardly sloped beneath lower spray arm assembly 144 toward tub sump portion 142, and tub sump portion is generally downwardly sloped toward a sump 150 in flow communication with the fluid circulation assembly (not shown in FIG. 2). Tub sump portion 142 includes a six-sided outer perimeter 152. Lower spray arm assembly is substantially centered within tub 104 and wash chamber 106, off-centered with respect to tub sump portion 142, and positioned above tub 104 and tub sump portion 142 to facilitate free rotation of spray arm 144.

Tub 104 and tub sump portion 142 are downwardly sloped toward sump 150 so that water sprayed from lower spray arm assembly 144, mid-level spray arm assembly 148 (shown in FIG. 1) and the upper spray arm assembly (not shown) is collected in tub sump portion 142 and directed toward sump 150 for filtering and re-circulation during a dishwasher system wash cycle. In addition, a conduit 154 extends beneath lower spray arm assembly 144 and is in flow communication with the fluid circulation assembly. Conduit 154 extends to a back wall 156 of wash chamber 106, and upward along back wall 156 for feeding wash fluid to mid-level spray arm assembly 148 and the upper spray arm assembly.

Figure 3:
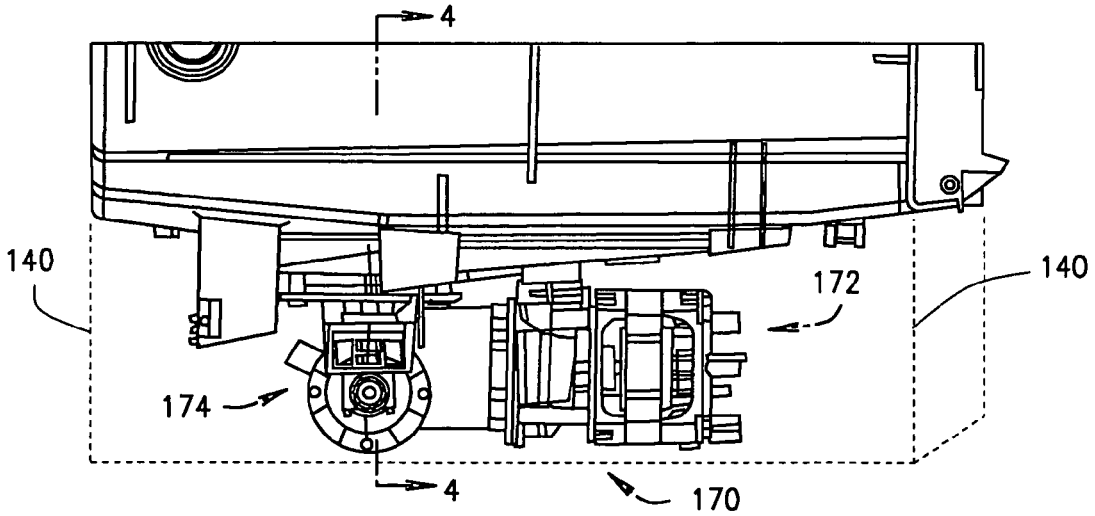
FIG. 3 is a partial side elevation view of the portion of the dishwasher system shown in FIG. 2.

FIG. 3 illustrates fluid circulation assembly 170 located below wash chamber 106 (shown in FIGS. 1 and 2) in machinery compartment 140 (shown in phantom in FIG. 3). Fluid circulation assembly 170 includes a main pump assembly 172 established in flow communication with a building plumbing system water supply pipe (not shown) and a drain pump assembly 174 in fluid communication with sump 150 (shown in FIG. 2) and a building plumbing system drain pipe (not shown).

Figure 4:
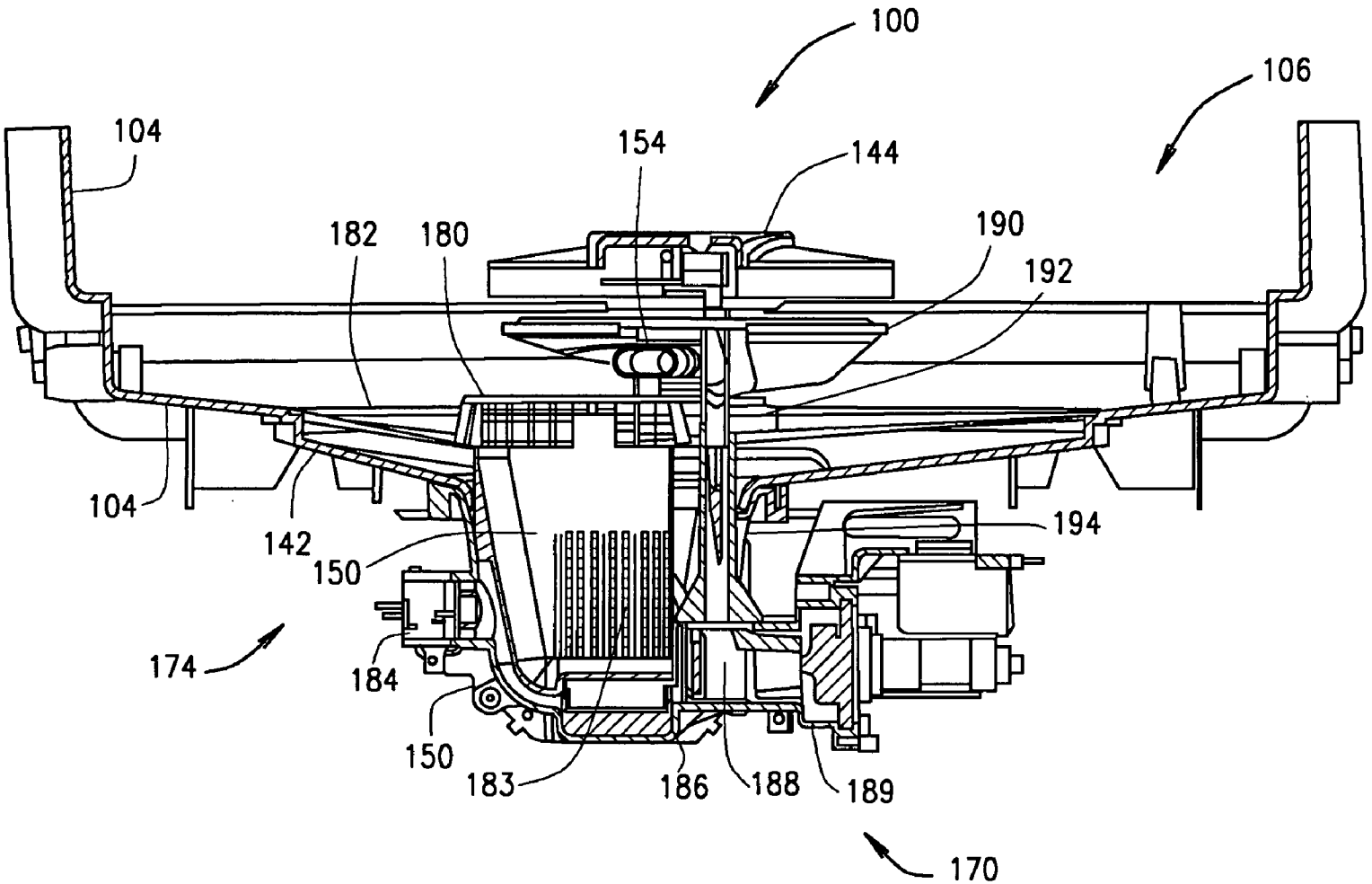
FIG. 4 is a cross sectional schematic view of the portion of the dishwasher system shown in FIG. 3 along line 44.

FIG. 4 is a cross sectional schematic view of dishwasher system 100, and more specifically of fluid circulating assembly 170 through drain pump assembly 174. Tub 104 is downwardly sloped toward tub sump portion 142, and tub sump portion is downwardly sloped toward sump 150. As wash fluid is pumped through lower spray arm assembly 144, and further delivered to mid-level spray arm assembly 148 (shown in FIG. 1) and the upper spray arm assembly (not shown), washing sprays are generated in wash chamber 106, and wash fluid collects in sump 150.

Sump 150 includes a cover 180 to prevent larger objects from entering sump 150, such as a piece of silverware or another dishwasher item that is dropped beneath lower rack 132 (shown in FIG. 1). A course filter 182 is located to filter wash fluid from sediment and particles of a predetermined size before flowing into sump 150 over tub sump portion 142. Wash fluid flowing through cover 180 flows through coarse inlet filter 183 into sump 150.

A drain check valve 186 is established in flow communication with sump 150 and opens or closes flow communication between sump 150 and a drain pump inlet 188. A drain pump 189 is in flow communication with drain pump inlet 188 and includes an electric motor for pumping fluid at inlet 188 to a pump discharge (not shown in FIG. 4) and ultimately to a building plumbing system drain (not shown). When drain pump 189 is energized, a negative pressure is created in drain pump inlet 188 and drain check valve 186 is opened, allowing fluid in sump 150 to flow into fluid pump inlet 188 and be discharged from fluid circulation assembly 170.

A fine filter assembly 190 is located below lower spray arm assembly and above tub sump portion 142. As wash fluid is pumped into lower spray arm 144 to generate a washing spray in wash chamber 106, wash fluid is also pumped into fine filter assembly 190 to filter wash fluid sediment and particles of a smaller size than coarse filters 182 and 183. Sediment and particles incapable of passing through fine filter assembly 190 are collected in fine filter assembly 190 and placed in flow communication with a fine filter drain tube 192 received in a fine filter drain docking member 194, which is, in turn, in flow communication with drain pump inlet 188. Thus, when pressure in fine filter assembly 190 exceeds a predetermined threshold, thereby indicating that fine filter assembly is clogged with sediment, drain pump 189 can be activated to drain fine filter assembly. Down jets (not shown) of lower spray arm assembly 144 spray fluid onto fine filter assembly 190 to clean fine filter assembly during purging or draining of fine filter assembly 190.

Set forth below are schematic illustrations of water flow control mechanisms that facilitate independent operation of the upper/mid level spray arms from the lower spray arm. More particularly, an upper rack wash can be performed by having water flow to only the upper and mid level spray arms while water flow to the lower spray arm is blocked. The upper rack wash operation facilitates reducing energy and water consumption when the lower spray arm is not required to perform a wash operation. More quiet operation also is possible because only the mid and upper spray arms are utilized rather than all the spray arms (i.e., lower, mid, and upper spray arms). As one example of when an upper rack wash could be performed is when only glasses and items placed in the upper rack are to be washed and there are no items in the lower rack. Additionally, the pump flow characteristics may be varied when only the mid and upper spray arms are utilized. For example, the pump may operate at a reduced output, thus facilitating reduced noise and/or reduced energy and water consumption.

Generally, a water flow blocking device, such as a ball valve, is utilized to control flow within the dishwasher. In one specific embodiment, the ball valve is located in a flow path at an outlet of the main water pump. A water passage is located at the pump outlet, and is positioned so that the ball of the ball valve seats in an inlet end of the water passage to block water flow therethrough. The water passage is in flow communication with the lower spray arm in that flow to the lower spray arm passes through the pump outlet and through the water passage.

The ball valve includes a blocking device such as a magnetic ball, a magnet or other magnetic component, and an electromechanical device. The magnet is coupled to the electromechanical device so that the magnet position relative to the ball is controlled by the device. The ball, in the one embodiment, is fabricated from a non-corrosive material that is magnetic or has a magnetic piece within it or a magnetic coating.

In operation, and when the device positions the magnet in a first position, the magnetic forces from the magnet are sufficient to retain the ball substantially out of the main flow from the pump. When the device positions the magnet in a second position, the magnetic forces from the magnet are not sufficient to retain the ball out of the main flow from the pump. As a result, water flow from the pump causes the ball to seat in the water passage inlet and block flow to the lower spray arm. Additionally, the device may be positioned at multiple positions to facilitate positioning the ball to control flow in the dishwasher. Alternative embodiments are also described herein.

Figure 5:
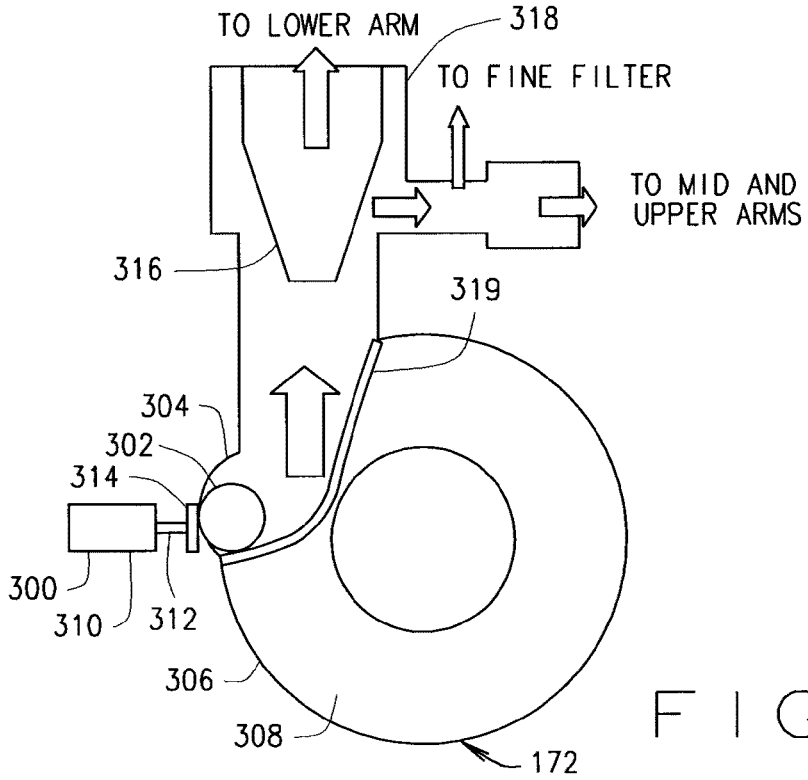
FIGS. 5 and 6 illustrate one embodiment wherein an electromechanical device is utilized to control movement and capture/release of a magnetic ball.
Figure 6:
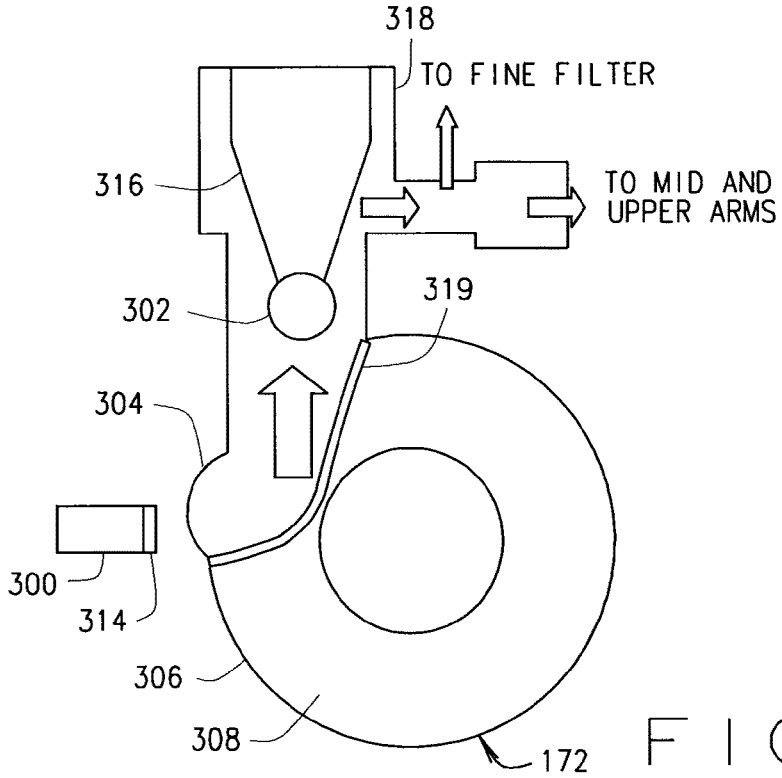

FIGS. 5 and 6 illustrate one embodiment wherein an electromechanical device 300 is utilized to control movement and capture/release of a magnetic ball 302. In one embodiment, and referring to FIG. 5, magnetic ball 302 is positioned at a resting place, such as, for example, within a pocket 304 formed in an outer wall 306 of pump 308 of pump assembly 172. In an alternative embodiment, magnetic ball 302 is positioned against outer wall 306 of pump 308 adjacent a plurality of ribs (not shown) to retain magnetic ball 302 at the resting place. Electromechanical device 300, such as a solenoid or a wax motor, is coupled to a spring 310 biased to force an arm 312 having a magnet 314 at an opposing end into a position wherein the magnetic forces from magnet 314 maintain ball 302 at the resting place, such as, within pocket 304. A water passage, such as a hub venturi 316, is downstream from pump 308. Hub venturi 316 defines a flow path to lower spray arm. Additionally, a water passage, such as a conduit, defines a flow path through a pump connector 318 having a L-shape to the mid and upper spray arms.

In operation, and when magnet 314 is in the position as shown in FIG. 5, magnetic ball 302 is maintained in pocket 304 and water flows from pump 308 and to both the lower arm and to the mid and upper arms. When the solenoid of device 300 is activated, as shown in FIG. 6, the magnetic forces from magnet 314 are insufficient to hold ball 302 in the pocket 304. As a result, the pump flow lifts and seats ball 302 in the venturi 316, which results in blocking flow to the lower arm. Water is allowed to flow to all other spray arms and filters. When pump 308 stops pumping, ball 302 drops from being seated in the venturi 316 and is guided back to the initial position by a ball guide 319.

Figure 7:
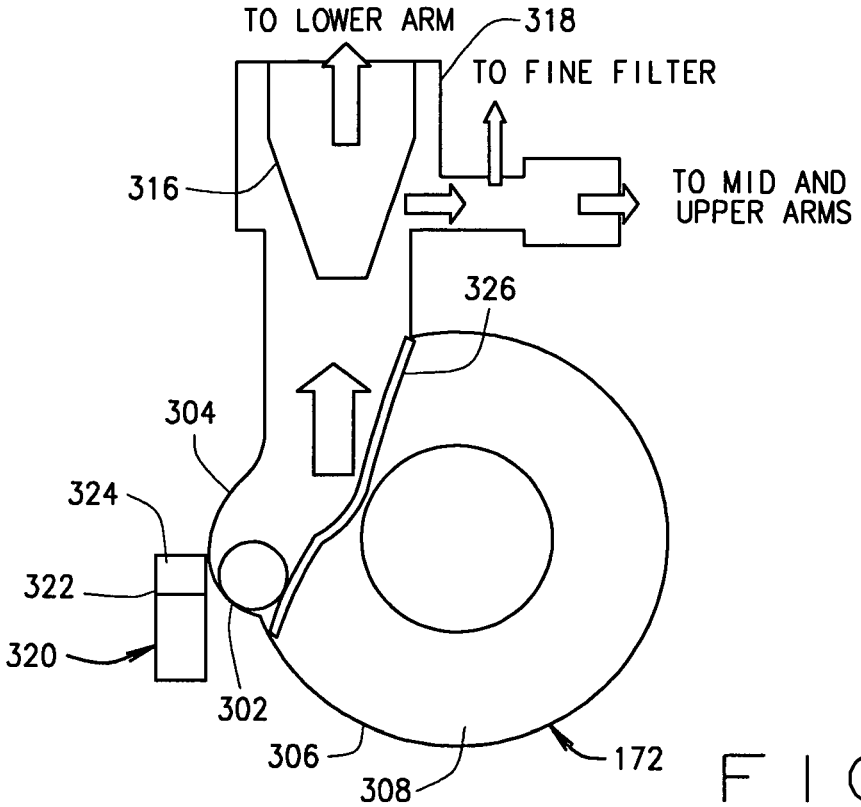
FIGS. 7 and 8 illustrate one embodiment wherein a electromagnetic device is utilized to control movement and capture/raise of a magnetic ball.
Figure 8:
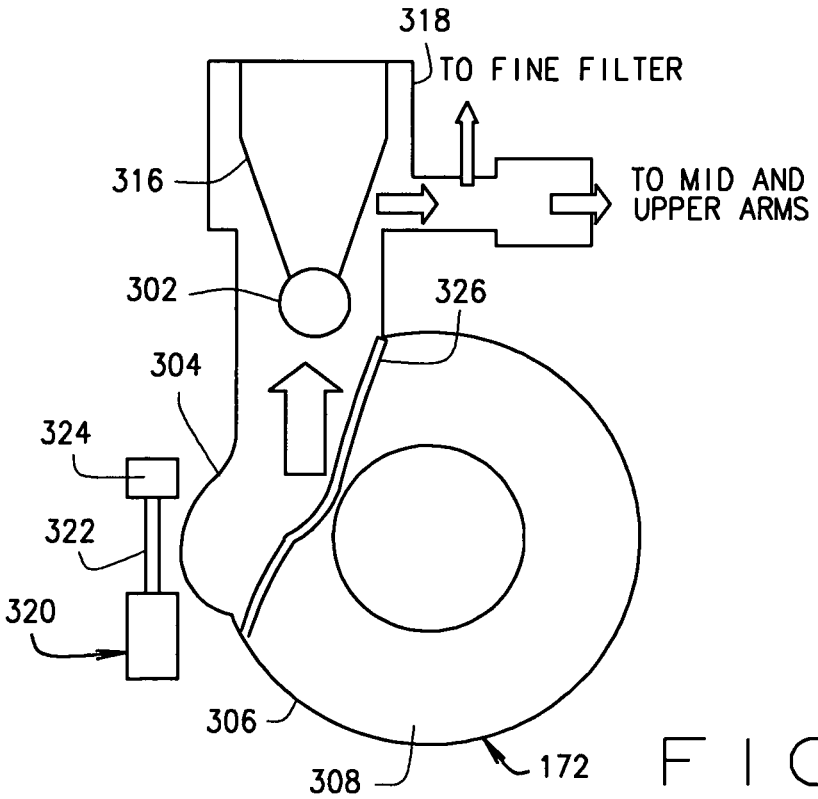

FIGS. 7 and 8 illustrate one embodiment wherein an electromechanical device 320 is utilized to control movement and capture/raise of ball 302. More specifically, and referring to FIG. 7, an electromechanically controlled arm 322 having a magnet 324 at one end thereof is positioned to maintain magnetic ball 302 in pocket 304 when in the position shown in FIG. 7. In this position, water is allowed to flow to all spray arms and filters. When electromechanically controlled arm 322 is extended as shown in FIG. 8, ball 302 is lifted out of pocket 304 and into the water flow. Ball 302 seats in venturi 316, and water flow to the lower spray arm is blocked. Water does flow, however, to all other spray arms and filters. When pump 308 stops, ball 302 unseats from the venturi and is directed back down into the pocket by a ball guide 326.

Figure 9:
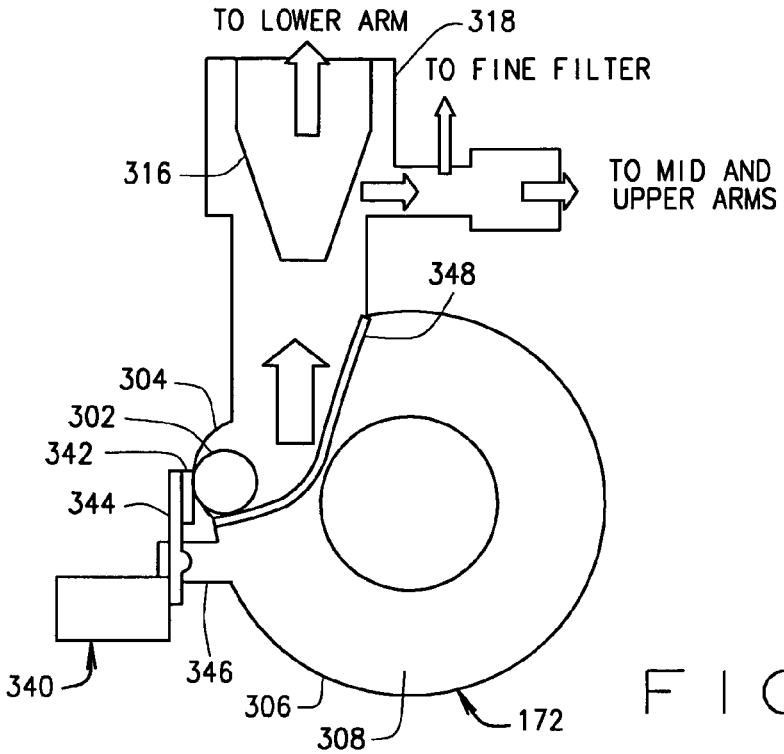
FIGS. 9 and 10 illustrate one embodiment wherein an electromagnetic device in conjunction with a mechanical assist device moves a magnet and captures/releases a magnetic ball.
Figure 10:
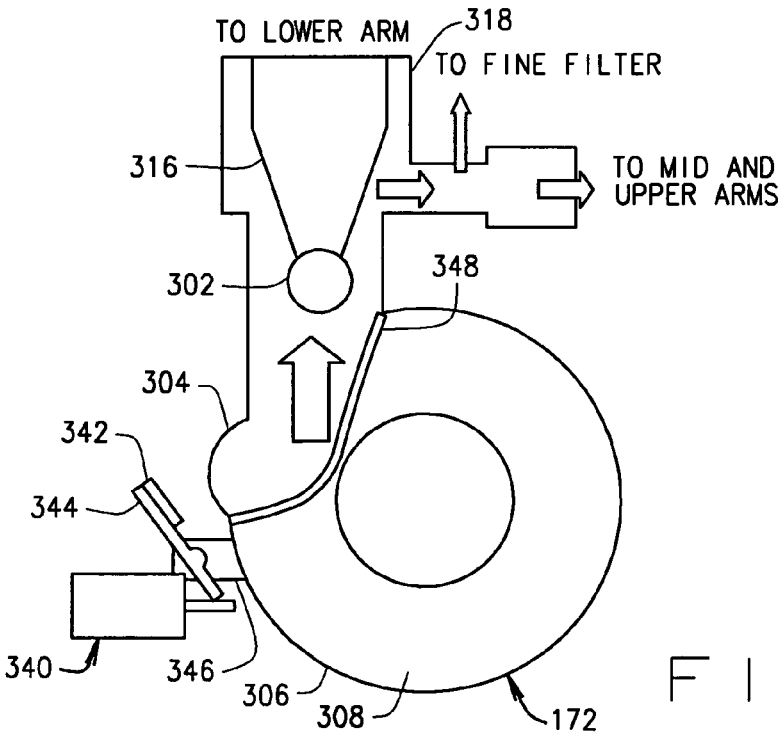

FIGS. 9 and 10 illustrate one embodiment wherein an electromechanical device 340 moves a magnet 342 and captures/releases ball 302. An electromechanically controlled arm 344 has magnet 342 at one end thereof, and arm 344 is rotatably coupled to an extension 346 of the pump housing. When positioned as shown in FIG. 9, the magnetic forces from magnet 342 maintain ball 302 in pocket 304. In this position, water is allowed to flow to all spray arms and filters.

When the electromechanical device 340 is energized, magnet 342 is moved away from pocket 304 and the magnetic forces from magnet 342 are insufficient to maintain ball 302 in pocket 304. As a result, ball 302 moves into the water flow and seats in venturi 316. In this position, water flow to the lower spray arm is blocked while water flow is permitted to all other spray arms and filters. When pump 308 stops pumping, ball 302 drops from being seated in venturi 316 and is guided back to the initial position by a ball guide 348.

Figure 11:
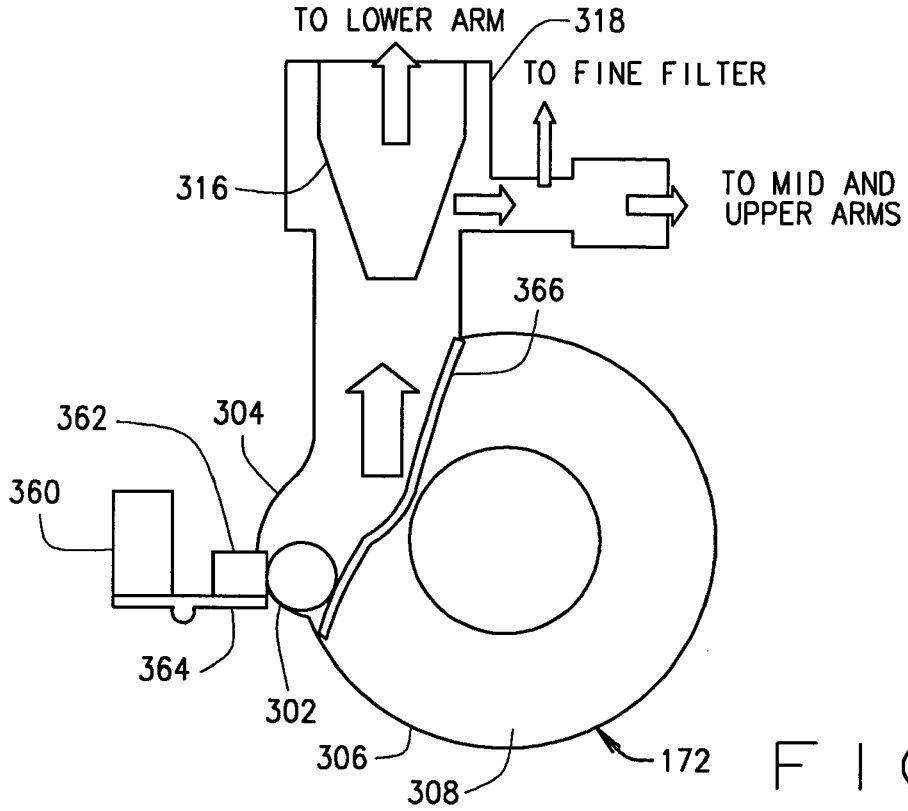
FIGS. 11 and 12 illustrate another embodiment wherein an electromagnetic device in conjunction with a mechanical assist device moves a magnet and captures/raises a magnetic ball.
Figure 12:
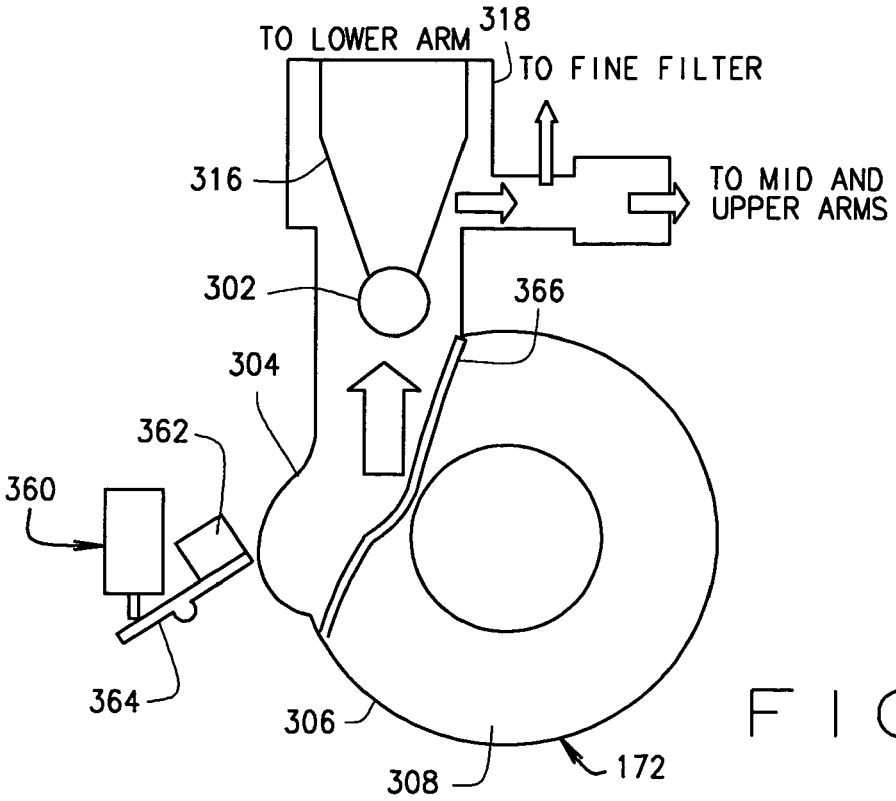

FIGS. 11 and 12 illustrate another embodiment wherein an electromechanical device 360 moves a magnet 362 and captures/raises ball 302. As shown in FIG. 11, magnet 362 is positioned near pocket 304 so that magnetic forces from magnet 362 maintain ball 302 in pocket 304. In this condition, water flow is permitted to all spray arms and filters.

When magnet 362 is moved away from pocket 304 by electromechanically controlled arm 364, as shown in FIG. 12, the magnetic forces from magnet 362 are insufficient to maintain ball 302 in pocket 304. Ball 302 moves into the water flow and seats in venturi 316. Water flow therefore is blocked to the lower spray arm and is permitted to all other spray arms and filters. When pump 308 stops pumping, ball 302 drops from being seated in venturi 316 and is guided back to the initial position by a ball guide 366.

Figure 13:
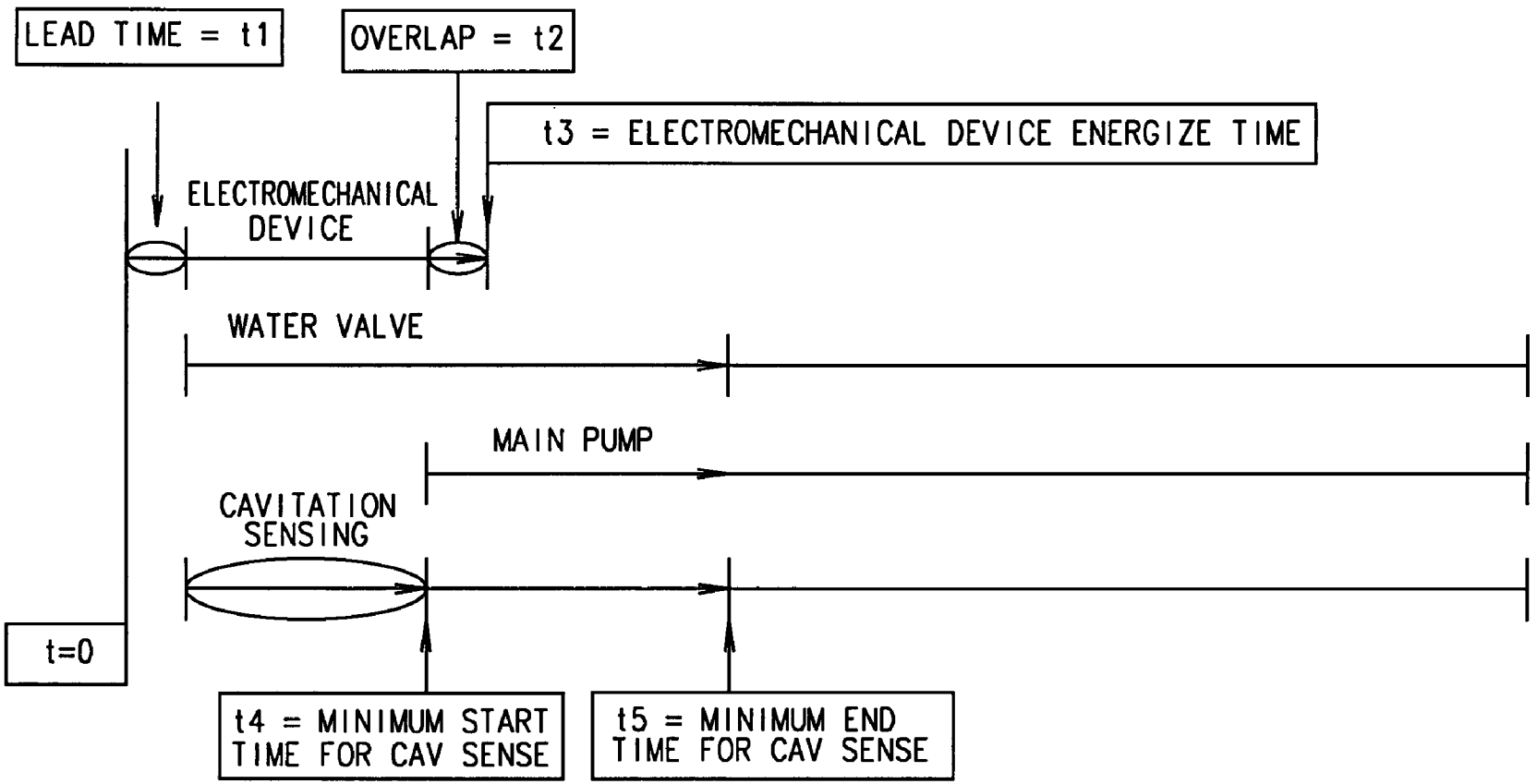
FIG. 13 illustrates a fill algorithm.

FIG. 13 illustrates an upper rack wash fill algorithm. Generally, for an upper rack wash, water flow to the lower rack is blocked and water flow to all other spray arms and filters is permitted. An upper rack wash may be performed when, for example, only glasses in the upper rack are to be washed and there are not items in the lower rack to be washed. Any of the configurations described and illustrated in connection with FIGS. 5-12 can be utilized.

Generally, between time t=0 and t=1, the electromechanical device is energized and the water valve is not energized. Therefore, the magnetic ball is permitted to move freely but without water flow, does not seat in the venturi. At time t1, the water valve is energized and water flow occurs. Then at time t2, the pump begins to pump water that has accumulated as a result of opening the water valve. At the time the pump is energized, the electromechanical device also is energized. As a result, the water flow carries the magnetic ball upward and causes the ball to seat in the venturi. In this position, water flow is blocked to the lower spray arm but is permitted to all other spray arms and filters. Even though the electromechanical device is de-energized at time t3, the magnetic ball remains seated in the venturi due to the continued flow of water.

As shown in FIG. 13, time t1 to t4 is the minimum time period if an adaptive filtering system is present. If not, the system defaults to time t4=t5. Time t5 is the minimum end time for cavitation sensing. The lead time t1 is calculated according to: t1=t3−t2−t4.

Figure 14:
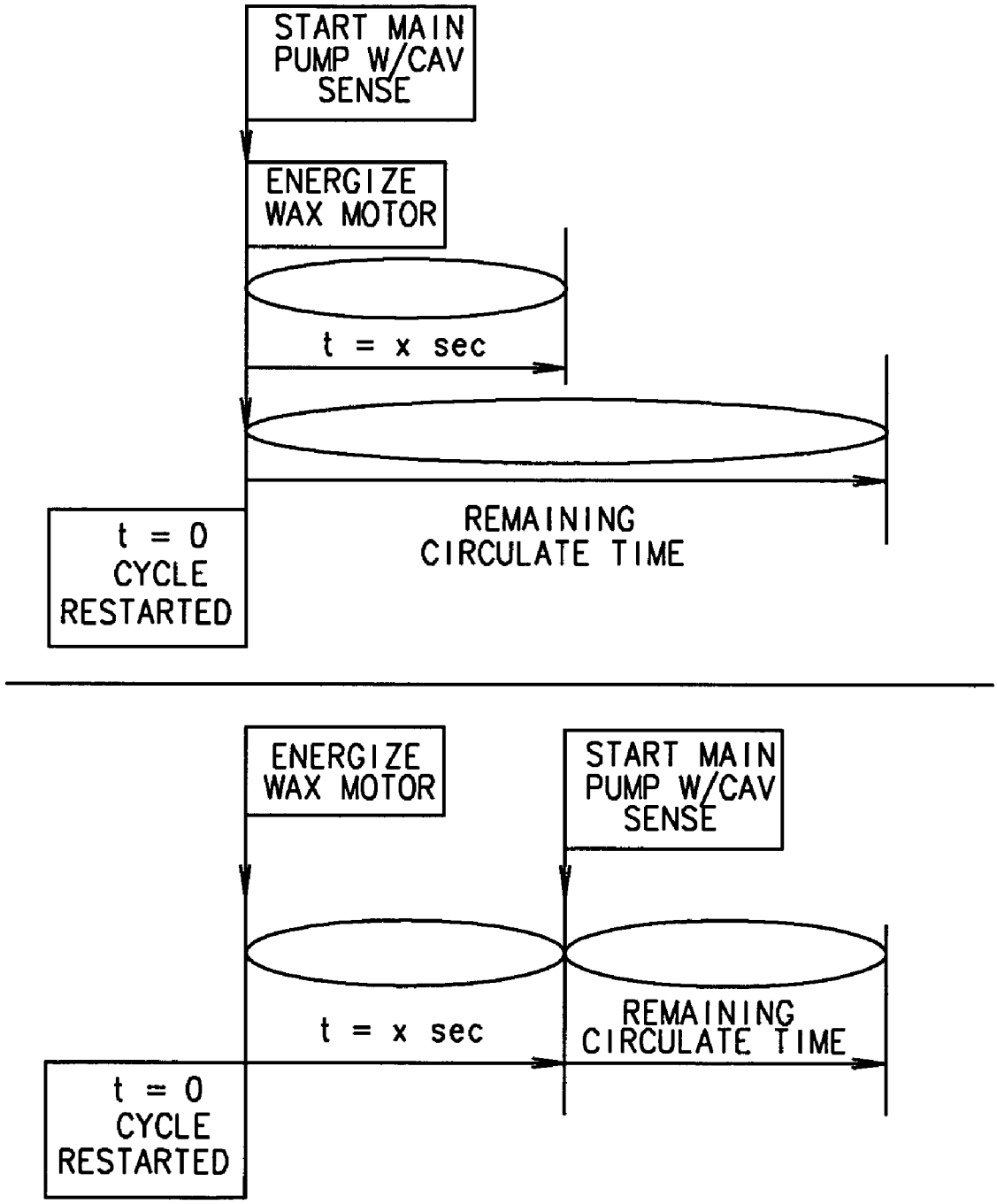
FIG. 14 illustrates an open door/interrupt cycle algorithm.

FIG. 14 illustrates an open door/interrupt cycle. Generally, when the dishwasher door is opened, the wash cycle is interrupted and needs to be restarted. More particularly, the cycle is restarted at a time t=0 when the dishwasher door is closed and locked. At time t=0, the main pump is re-energized and the electromechanical device is re-energized if no time delay is required. As a consequence, the magnetic ball is moved upward by the water flow and seats in the venturi. Water flow to the lower spray arm is blocked and water flow to all other spray arms and filters is permitted. At time=x, the electromechanical device is de-energized, however, the magnetic ball remains seated against the venturi by the water flow. Therefore, the upper rack wash operation continues with no water flow to the lower spray arm.

If a time delay is required, and at time t=0, the electromechanical device is energized. This results in the magnetic ball being free to move. Then, at a time t=x, the pump is energized to re-initiate water flow. The water flow carries the magnetic ball upwards and causes the ball to seat in the venturi. Water flow is blocked to the lower spray arm, but is permitted to flow to all other spray arms and filters.

The above described control facilitates performing an upper rack wash in a dishwasher. Such an operation facilitates reducing the energy and water consumption that would otherwise be required in a dishwasher that provides water flow to all spray arms even when only items are located in the upper rack. In addition, such upper rack wash facilitates quieter washing operations when performing only an upper rack wash operation as compared to when water flow is permitted to all spray arms.

While the invention has been described in terms of various specific embodiments, those skilled in the art will recognize that the invention can be practiced with modification within the spirit and scope of the claims.

What is claimed is:

1. A dishwasher comprising:

a tub;

a fluid circulation assembly for circulating water, said assembly comprising a pump, a first spray arm, and a second spray arm, said pump in flow communication with said first spray arm via a first water passage, said pump in flow communication with said second spray arm via a second water passage; and a water flow blocking mechanism comprising a magnetic water flow blocking device, a magnet positioned outside a conduit providing flow communication between said pump and said first water passage and said second water passage, and a magnet positioning device coupled to said magnet, said magnetic water flow blocking device normally positioned in a pocket formed in said conduit, said magnet positioning device configured to cause said magnet to move from a first position to a second position, such that when said magnet is in said second position said magnetic water flow blocking device is not retained in said pocket by magnetic forces of said magnet and said conduit is configured to channel water only to said second water passage, said magnet positioning device further configured to cause said magnet to move from said second position to said first position while said pump is operating, such that when said magnet is in said first position said magnetic water flow blocking device is maintained in said pocket by a magnetic force of said magnet and said conduit is configured to channel water to said first water passage and said second water passage.

2. A dishwasher in accordance with claim 1 wherein said magnetic water flow blocking device is configured to block said first water passage when said magnet is moved from the first position and prevents water flow to said first spray arm.

3. A dishwasher in accordance with claim 1 wherein said magnetic water flow blocking device is moveable within said conduit by said water flow when said magnet is in said second position.

4. A dishwasher in accordance with claim 1 wherein pump flow characteristics of said pump are varied when said magnetic water flow blocking device is moved from said pocket, such that water flow to said first arm is prevented.

5. A dishwasher in accordance with claim 1 further comprising a magnetic water flow blocking device positioning guide oriented to direct said magnetic water flow blocking device into said pocket in the absence of a water flow through said pump.

6. A dishwasher in accordance with claim 1 wherein said magnetic positioning device is moveable between a first position and a second position, said magnetic positioning device configured to retain said magnetic water flow blocking device in said first position when said magnetic positioning device is in said first position.

7. A dishwasher in accordance with claim 6 wherein said magnetic positioning device is moveable in a direction substantially perpendicular to the direction of water flow.

8. A dishwasher in accordance with claim 6 wherein said magnetic positioning device is moveable in a direction substantially parallel to the direction of water flow.

9. A dishwasher in accordance with claim 6 wherein said magnetic positioning device is moveable in a generally arcuate direction away from said pocket.

10. A dishwasher in accordance with claim 6 wherein said magnetic positioning device comprises a pivot arm for rotating said magnet away from said pocket to release said magnetic water flow blocking device to said second position.

11. A kit comprising:

a magnetic water flow blocking device positionable in a pocket formed in a conduit;

a magnet configured to magnetically engage said magnetic water flow blocking device, said magnet positioned outside said conduit; and a magnet positioning device configured to be coupled to said magnet, said magnet positioning device configured to cause said magnet to move from a first position to a second position, such that when said magnet is in said second position said magnetic water flow blocking device is moveable within said conduit and said conduit is configured to channel water only to said second water passage, said magnet positioning device further configured to cause said magnet to move from said second position to said first position while a pump is operating, such that when said magnet is in said first position said magnetic water flow blocking device is retained by said magnet within said pocket and said conduit is configured to channel water to said first water passage and said second water passage.

12. A kit in accordance with claim 11 further comprising a pump housing having said pocket defined therein.

13. A kit in accordance with claim 12 wherein said pump housing defines a flow path therethrough, said pocket configured to retain said magnetic water flow blocking device away from said flow path.

14. A kit in accordance with claim 12 wherein said pump housing is configured to be coupled in flow communication with a first spray arm of a dishwasher via a first water passage and in flow communication with a second spray arm via a second water passage, and wherein said conduit permits water flow around said first water passage.

15. A kit in accordance with claim 14 wherein said magnetic water flow blocking device is configured to block water flow to said first water passage.

16. A kit in accordance with claim 11 wherein said magnet positioning device is moveable in a substantially linear direction.

17. A kit in accordance with claim 11 wherein said magnet positioning device is moveable in a generally arcuate direction.

* * * * *